US006540488B2

(12) United States Patent
Takai et al.

(10) Patent No.: US 6,540,488 B2
(45) Date of Patent: Apr. 1, 2003

(54) SLANT PLATE-TYPE VARIABLE DISPLACEMENT COMPRESSORS WITH CAPACITY CONTROL MECHANISMS

(75) Inventors: Kazuhiko Takai, Isesaki (JP); Makoto Tamura, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/862,342

(22) Filed: May 23, 2001

(65) Prior Publication Data

US 2001/0046444 A1 Nov. 29, 2001

(30) Foreign Application Priority Data

May 24, 2000 (JP) ..... 2000-157968

(51) Int. Cl.[7] ..... F04B 1/26; F04B 1/12

(52) U.S. Cl. ..... 417/222.2; 417/222.1; 417/269

(58) Field of Search ..... 417/222.1, 222.2, 417/269; 92/71

(56) References Cited

U.S. PATENT DOCUMENTS 4,688,997 A * 8/1987 Suzuki et al. ..... 417/222.2
4,702,677 A * 10/1987 Takenaka et al. ..... 417/222.2
4,723,891 A * 2/1988 Takenaka et al. ..... 417/222.2
4,730,986 A * 3/1988 Kayukawa et al. ..... 417/222.2
4,780,060 A 10/1988 Terauchi
4,874,295 A 10/1989 Kobayashi et al.
4,878,817 A 11/1989 Kikuchi et al.
4,913,627 A * 4/1990 Terauchi ..... 417/222.2
4,960,367 A 10/1990 Terauchi
5,741,122 A * 4/1998 Yokono et al. ..... 417/222.2
6,074,173 A 6/2000 Taguchi
6,099,276 A 8/2000 Taguchi
6,102,670 A 8/2000 Taguchi
6,129,519 A 10/2000 Ogura
6,179,572 B1 1/2001 Taguchi
6,196,808 B1 3/2001 Taguchi
6,257,848 B1 7/2001 Terauchi

* cited by examiner

*Primary Examiner*—Charles G. Freay
*Assistant Examiner*—Timothy P. Solak
(74) *Attorney, Agent, or Firm*—Baker Botts L.L.P.

(57) ABSTRACT

A slant plate-type variable displacement compressor includes a housing enclosing a crank chamber, a suction chamber, and a discharge chamber. The housing includes a cylinder block, and cylinder bores are formed therein. Pistons are slidably disposed within the cylinder bores. A valve member is disposed in a first passage, which communicates between a discharge side of the cylinder bore and the crank chamber. The valve member is controlled by a suction pressure of the cylinder bore. A second passage communicates between the crank chamber and a suction side of the cylinder bore through an orifice for allowing pressure to release. A cross-sectional area of the orifice is variably controlled, such that when compressor operation begins, the cross-sectional area of the orifice is greater than that during a capacity control operation.

3 Claims, 2 Drawing Sheets

SLANT PLATE-TYPE VARIABLE DISPLACEMENT COMPRESSORS WITH CAPACITY CONTROL MECHANISMS

BACKGROUND OF THE INVENTION

1. Field of the Invention

The present invention relates to variable displacement compressors in automotive air conditioning systems, and more particularly, to slant plant-type variable displacement compressors with capacity control mechanisms.

2. Description of Related Art

Slant plate-type variable displacement compressors having capacity control mechanisms are known in the art. For example, Japanese Second Patent Publication (Examined) No. 5-83751 describes a slant plate-type compressor, more particularly, a wobble plate-type compressor having a variable displacement control mechanism in an automotive air conditioning system. In such automotive air conditioning systems, the compressor is driven by an engine of a vehicle.

This wobble plate-type compressor includes a valve member and a first passage, which communicates between a crank chamber and a suction side of a cylinder bore via a fixed orifice so as to allow pressure to release. The valve member is disposed in a second passage, which communicates between a discharge side of the cylinder bore and the crank chamber so as to provide a discharge pressure. The valve member is controlled by a suction pressure of the cylinder bore.

In operation, if the suction pressure within the cylinder bore is less than a predetermined value when the load on a fluid circuit, for example, a cooling circuit, of the air conditioning system is low, the valve member opens the second passage. Refrigerant gas from the discharge side of the cylinder bore is provided to the crank chamber, and pressure in the crank chamber increases. As a result, the difference between a first moment increasing a tilt angle between a wobble plate and a drive shaft and a second moment decreasing a tilt angle between the wobble plate and the drive shaft may be decreased. The first moment is results from a reaction force of a compression, which affects pistons. The second moment is results from the pressure in the crank chamber. Consequently, the tilt angle between the wobble plate and the drive shaft decrease, and the discharge capacity of this compressor may decrease. Alternatively, if the suction pressure of the cylinder bore is greater than a predetermined value when the load on the fluid circuit of the air conditioning system is high, the valve member closes the second passage, and refrigerant gas in the discharge side of the cylinder bore is not provided to the crank chamber. Refrigerant gas in the crank chamber flows to the suction side of the cylinder bore through the first passage because of the difference between the pressure in crank chamber and the suction pressure of the cylinder bore. As a result, the difference between the first moment and the second moment may be increased. Consequently, the tilt angle between the wobble plate and the drive shaft may increase, and the discharge capacity of this compressor may increase.

In this compressor, the orifice is disposed in the first passage, which communicates between the crank chamber and the suction side of the cylinder bore so as to allow pressure to release. The orifice reduces or eliminates the excessive flow of refrigerant gas from the crank chamber to the suction side of the cylinder bore, and a rapid decrease of the pressure in the crank chamber may be suppressed. As a result, a rapid increase of the discharge capacity may also be suppressed when the discharge capacity is increased in response to an increase of the load on the fluid circuit, and a rapid decrease of blowoff temperature of the air conditioning system may be suppressed.

In this compressor, just after the compressor operation begins, the valve member disposed in the first passage closes the first passage, and the discharge capacity is at a minimum discharge capacity. By starting the compressor operation, refrigerant gas flows from the suction side to the discharge side of the cylinder bore, and the suction pressure of the cylinder bore decreases. The difference between the pressure in the crank chamber and the suction pressure of the cylinder bore may occur, and refrigerant gas in the crank chamber may flow to the suction side of the cylinder bore. The pressure in the crank chamber may decrease because refrigerant gas flows to the suction side of the cylinder bore. Therefore, the difference between the first moment and the second moment increases, and the tilt angle between the wobble plate and the drive shaft may increase. As a result, the discharge capacity of this compressor may be increased, and the requisite amount of refrigerant gas may be provided to the fluid circuit.

In this compressor, however, just after the compressor operation begins, the discharge capacity is at a minimum discharge capacity, and the discharge pressure of cylinder bore is low. The moment, which increases the tilt angle between the wobble plate and the drive shaft and which arises from the reaction force of compression affecting pistons, is small. Therefore, the difference between the first moment and the second moment is small. Moreover, just after the compressor operation begins, the degree of suction preserve in the cylinder bore is reduced because the discharge capacity reaches a minimum capacity, and the difference between the pressure in the crank chamber and the suction pressure of the cylinder bore is reduced. Therefore, if the orifice is disposed in the first passage so as to allow the pressure to release, the flow of refrigerant gas from the crank chamber to the suction side of the cylinder bore may become slightly smaller because of a flow resistance created by the orifice, and the rate of pressure release in the crank chamber may become slightly smaller. Accordingly, a reduced rate of change of the moment, which decreases the tilt angle between the wobble plate and the drive shaft and which arises from the pressure in the crank chamber, may become slightly smaller. The difference between the first moment and the second moment, in other words, an increased rate of change of the difference between the first moment and the second moment may become slightly smaller, and this slightly smaller difference may be maintained. As a result, the requisite amount of refrigerant gas may not be provided to the fluid circuit because a rapid increase of the discharge capacity is hindered.

SUMMARY OF THE INVENTION

A need has arisen to reduce or eliminate the above-mentioned problems, which may be encountered in known slant plate-type variable displacement compressors with capacity control mechanisms.

In an embodiment of this invention, a slant plate-type variable displacement compressor comprises a housing enclosing a crank chamber, a suction chamber, and a discharge chamber. The housing comprises a cylinder block, and a plurality of cylinder bores are formed in the cylinder block. A drive shaft is rotatably supported in the cylinder block. A plurality of pistons are slidably disposed within the cylinder bores. A slant plate has an angle of tilt and is tiltably connected to the drive shaft. A plurality of bearings couple the slant plate to each of the pistons, so that the pistons reciprocate within the cylinder bores upon rotation of the slant plate. A valve member is disposed in a first passage. The first passage communicates between a discharge side of the cylinder bore and the crank chamber. The valve member is controlled by a suction pressure produced within the cylinder bore. A second passage communicates between the crank chamber and a suction side of the cylinder bore through an orifice. The second passage allows pressure to release. A cross-sectional area of the orifice is variably controlled, such that the cross-sectional area of the orifice when a compressor operation begins is greater than during a capacity control operation.

Objects, features, and advantages of embodiments of this invention will be apparent to persons of ordinary skill in the art from the following detailed description of the invention and the accompanying drawings.

BRIEF DESCRIPTION OF THE DRAWINGS

The present invention may be more readily understood with reference to the following drawings.

DETAILED DESCRIPTION OF PREFERRED EMBODIMENTS

Figure 1:
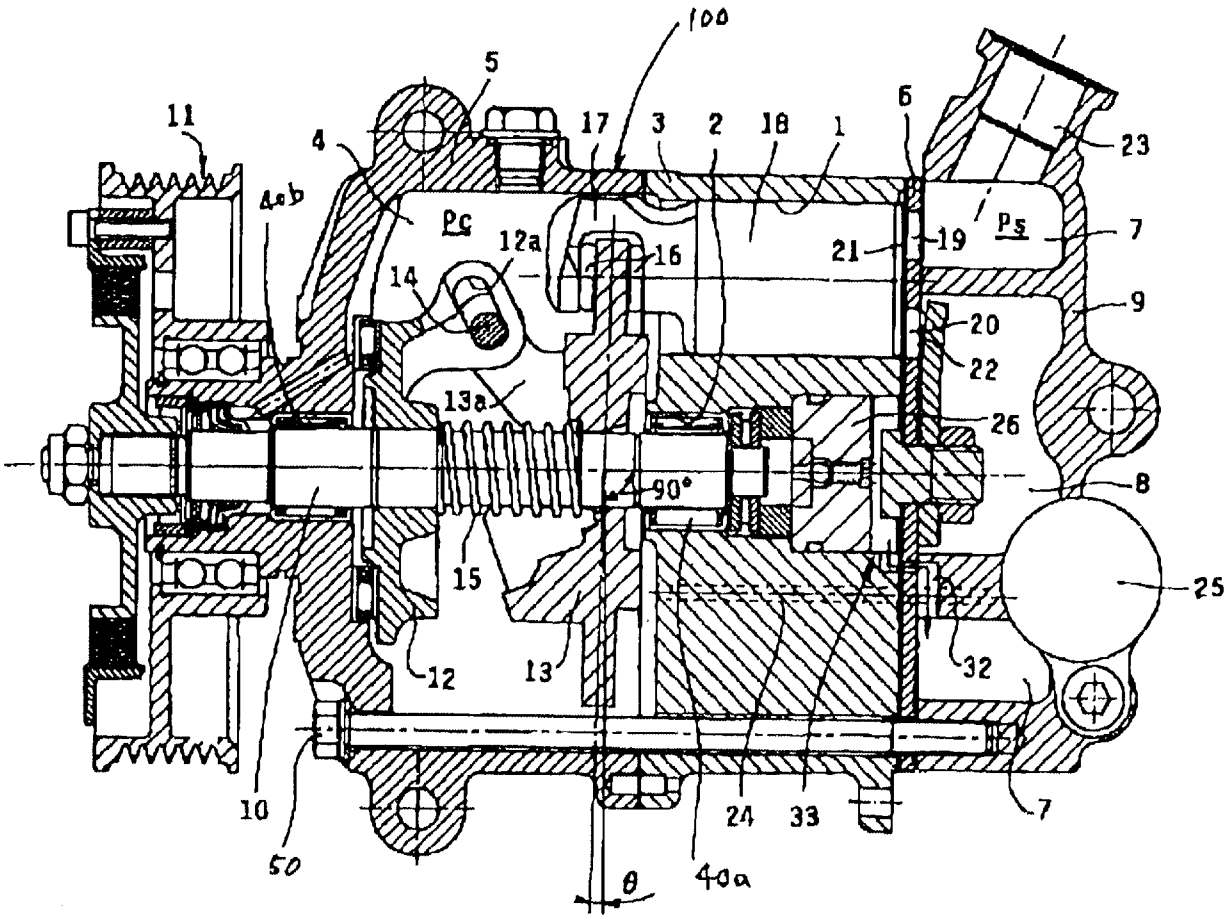
FIG. 1 is a longitudinal, cross-sectional view of a slant plate-type compressor, according to an embodiment of the present invention.

Referring to FIG. 1, a longitudinal, cross-sectional view of a slant plate-type compressor having a capacity control mechanism for use in an automotive air conditioning system, according to an embodiment of the present invention, is shown. A slant plate-type compressor 100 comprises a cylinder block 3, a front housing 5, a cylinder head 9, and a valve plate 6. Cylinder block 3 having a substantially cylindrical shape is closed by front housing 5 from one side to form a crank chamber 4, and is closed by cylinder head 9 from the other side via valve plate 6 to form a suction chamber 7 and a discharge chamber 8. Cylinder block 3, front housing 5, cylinder head 9, and valve plate 6 are fixed together by a plurality of bolts 50. A plurality of cylinder bores 1 are formed in cylinder block 3 and are radially arranged with respect to the central axis of cylinder block 3. A central bore 2 is formed around the central axis of cylinder block 3. A drive shaft 10 extends along a central axis of compressor 100 and through crank chamber 4, and is rotatably supported by front housing 5 and central bore 1 of cylinder block 3 through radial bearings 40*a* and 40*b*, respectively. A pulley 11, which is rotatably supported by and mounted on front housing 5, is connected to drive shaft 10. A drive belt (not shown) is provided to transfer motion between pulley 11 and a crankshaft of an engine of a vehicle (not shown).

A cam rotor 12 is fixed on drive shaft 10 and is located in crank chamber 4. Cam rotor 12 is supported by front housing 5 around drive shaft 10. A slot 12*a* is formed in cam rotor 12. A slant plate 13 is disposed in crank chamber 4 and is slidably mounted on drive shaft 11, so that its inclination angle may vary. Slant plate 13 has an arm portion 13*a*, which extends toward cam rotor 12. A pin member 14, which is fixed to arm portion 13*a*, is inserted into slot 12*a* of cam rotor 12 to create a hinged point. Pin member 14 is slidable within slot 12*a* to allow adjustment of the angular position of slant plate 13 with respect to the longitudinal axis of drive shaft 10. Slant plate 13 is urged away from cam rotor by a coil spring 15, which is engaged co-axially with drive shaft 10. A plurality of pairs of hemispherical sliding shoes 16 are radially disposed on either side surface of slant plate 13 and are arranged with respect to the central point of each side surface of slant plate 13. Each of the pairs of sliding shoes 16 are slidably supported by connecting rods 17. Each of pistons 18 having connecting rods 17 is accommodated in one of cylinder bores 1 and is independently and reciprocally movable therein.

Suction chamber 7 and a discharge chamber 8 are formed in cylinder head 9 and are adjacent to valve plate 6. Suction ports 19 and discharge ports 20 are formed at valve plate 6 for each of cylinder bores 1. A suction reed valve 21, which is disposed between cylinder block 3 and valve plate 6, opens and closes suction port 19. A discharge reed valve 22, which is disposed between cylinder head 9 and valve plate 6, opens and close discharge port 20. Suction chamber 7 communicates with a fluid inlet port 23. Discharge chamber 8 communicates with a fluid outlet port (not shown). A first passage 24 communicating between crank chamber 4 and discharge chamber 8 to provide a discharge pressure is formed through cylinder block 3, valve plate 6, and cylinder head 9. A control valve 25 opens or loses first passage 24.

Figure 2:
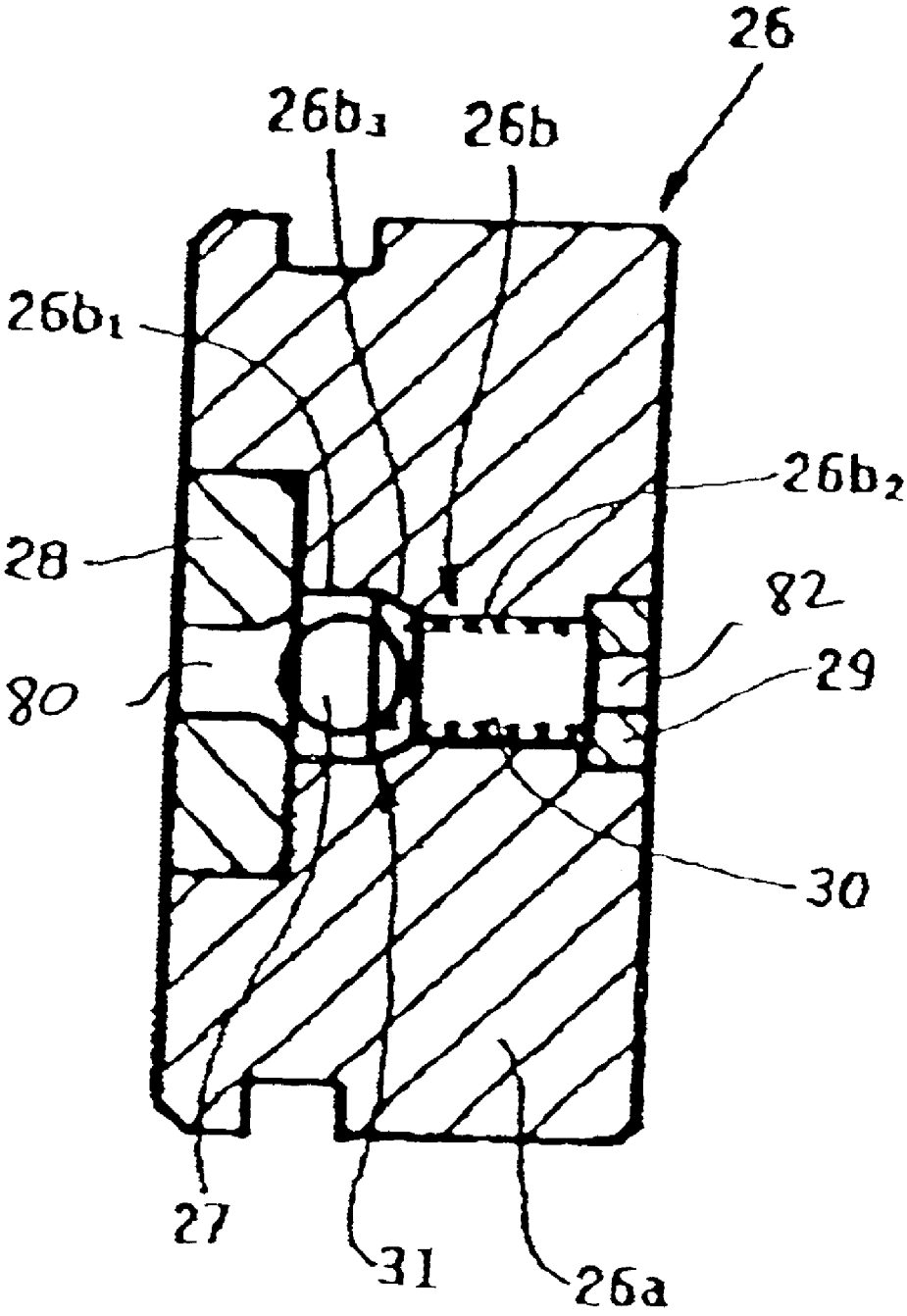
FIG. 2 is an enlarged view of an orifice depicted in FIG. 1, according to the embodiment of the present invention.

A variable orifice 26 is inserted into central bore 2. As shown in FIG. 2, variable orifice 26 has an orifice member 26*a*. An orifice opening 26*b* is formed in orifice member 26*a*. Orifice opening 26*b* has a large diameter portion $\mathbf{26}b_1$, a smaller diameter portion $\mathbf{26}b_2$, and a funnel portion $\mathbf{26}b_3$. Larger diameter portion $\mathbf{26}b_1$ is located at the side of orifice opening 26*b* adjacent to crank chamber 4. Smaller diameter portion $\mathbf{26}b_2$ is located at the side of orifice opening 26*b* distant from crank chamber 4. Funnel portion $\mathbf{26}b_3$ is located between larger diameter portion $\mathbf{26}b_1$ and smaller diameter portion $\mathbf{26}b_2$. A ball member 2, which may be made of steel, is disposed in orifice opening 26*b*. The diameter of ball member 27 is greater than that of smaller diameter portion $\mathbf{26}b_2$ of orifice opening 26*b*. A first cap 28 is fitted into an end side surface of orifice member 26*a* adjacent to crank chamber 4 and faces orifice opening 26*b*. A first opening 80 communicating with large diameter portion $\mathbf{26}b_1$ of orifice opening 26*b* is formed through first cap 28. A second cap 29 is fitted into an end side surface orifice member 26*a* distant from crank chamber 4 and faces orifice opening 26*b*. A second opening 82 communicating with smaller diameter portion $\mathbf{26}b_2$ of orifice opening 26*b* is formed through second cap 29. A spring 30 is disposed in orifice opening 26*b*. One end of spring 30 is fixed to ball member 27 and the other end of spring 30 is fixed to second cap 29. A annular opening, which is formed between an annular wall of orifice opening 26 and ball member 27, forms an orifice 31. Orifice 31 communicates between crank chamber 4 through central bore 2 and suction chamber 7 through a second passage 32. Moreover, orifice 31 and second passage 32 may allow pressure to be released.

In compressor operation, because pressure Ps in suction chamber 7 decreases, a difference between pressure Pc in crank chamber 4 and pressure Ps in suction chamber 7 occurs. Consequently, refrigerant gas in crank chamber 4 flows to suction chamber 7 through third passage 32. Refrigerant gas, which flows through orifice opening 26*b* of variable orifice 26 disposed in third passage 33, pushes ball member 27 in a downstream direction with respect to a flow refrigerant gas. Contrarily, spring 30 pushes ball member 27 in an upstream direction with respect to the flow of refrigerant gas. When pressure difference $\Delta P$ between pressure Pc in crank chamber 4 and pressure Ps in suction chamber 7

(ΔP=Pc−Ps) increases, the force of the flow of refrigerant gas to ball member 27 increases. As a result, ball member 27 moves in a downstream direction with respect to the flow of refrigerant gas against a force of spring 30. When pressure difference ΔP is less than ΔP1, the center of ball member 27 is located in larger diameter portion 26$b_1$ of orifice opening 26*b*. When pressure difference ΔP exceeds ΔP1 and is less than ΔP2, the center of ball member 27 is located in funnel portion 26$b_3$ of orifice opening 26*b*. When pressure difference ΔP exceeds ΔP2, the center of ball member 27 is located in smaller diameter portion 26$b_2$ of orifice opening 26*b*. As a result, a cross-sectional area S of annular orifice 31, which is formed between the annular wall of orifice opening 26 and ball member 27, may reach a maximum value when pressure difference ΔP is less than ΔP1. When pressure difference ΔP exceeds ΔP1, a cross-sectional area S1 of annular orifice 31 may decrease in accordance with an increase of pressure difference ΔP. When different pressure ΔP exceeds ΔP2, a cross-sectional area S2 of annular orifice 31 may reach a minimum value. Pressure difference ΔP1 and ΔP2 may be changed by changing a spring constant of spring 30. Fluid inlet port 23 is connected to a low pressure side of a fluid circuit, for example, a cooling circuit, and the discharge port is connected to a high pressure side of the fluid circuit.

In operation, when a driving force is transferred from the engine of the vehicle via the drive belt and pulley 11, drive shaft 10 is rotated. Pulley 11 transmits a rotating force to drive shaft 10, or disconnects a rotating force from drive shaft 10. The rotation of drive shaft 10 is transferred to cam rotor 21 and the rotation of cam rotor 21 is transferred to slant plate 13 through the hinge coupling mechanism, so that, with respect to the rotation of cam rotor 21, the inclined surface of slant plate 13 moves axially to the right and left. Consequently, pistons 18, which are operatively connected to slant plate 13 at connecting rods 17 by means of sliding shoes 16, reciprocate within cylinder bores 1. As pistons 18 reciprocate, refrigerant gas, which is introduced into suction chamber 7 from fluid inlet port 23, is drawn into each cylinder bore 1 and is compressed. Pressure from the compressed refrigerant gas opens discharge reed valve 21, and the refrigerant gas is discharged into discharge chamber 8 from each cylinder bores 1 and therefrom into the fluid circuit through the fluid outlet port (not shown).

In operation of compressors according to this embodiment of the present invention, pistons 18 receive a reaction force of compression. As a result, a moment M1 occurs. Moment M1 increases the tilt angle θ between slant plate 13 and drive shaft 10 that turns slant plate 13 on pin member 14 in a clockwise direction in FIG. 1. At this time, a moment M2 occurs due to coil spring 15. Moment M2 decreases tilt angle θ between slant plate 13 and drive shaft 10 that turns slant plate 13 on pin member 14 in a counterclockwise direction in FIG. 1. Moreover, a moment M3 occurs due to pressure Pc in crank chamber 4. Moment M3 decreases the tilt angle θ between slant plate 13 and drive shaft 10 that turns slant plate 13 on pin member 14 in a counterclockwise direction in FIG. 1.

A predetermined discharge temperature of the automobile air conditioning system is adjusted automatically with respect to temperature outside or by hand, and the load on the fluid circuit is hanged. When pressure Ps in section chamber 7 is less than predetermined value Ps1 due to a decrease of the load on the fluid circuit, control valve 25 opens first passage 24, and refrigerant gas in discharge chamber 8 flows to crank chamber 4 through first passage 24. As a result, pressure Pc in crank chamber 4 increases, and tilt angle 0 between slant plate 13 and drive shaft 10 decreases due to an increase of moment M3. Consequently, the length of the strokes of pistons 18 may decrease, and the discharge capacity of compressor 100 may decrease. On the contrary, however, when pressure Ps in suction chamber 7 exceeds predetermined value Ps1 due to an increase in the load on the fluid circuit, control valve 25 closes first passage 24, and this prevents refrigerant gas in discharge chamber 8 from flowing to crank chamber 4 through first passage 24. Refrigerant gas in crank chamber 4 flows to suction chamber 7 through third passage 33 due to pressure difference ΔP between pressure Pc in crank chamber 4 and pressure Ps in section chamber 7. As a result, pressure Pc in crank chamber 4 decreases, and tilt angle 0 between slant plate 13 and drive shaft 10 increases due to a decrease of moment M3. Consequently, the length of the strokes of pistons 18 may increase, and the discharge capacity of compressor 100 may increase.

When compressor operation begins, pressure Ps in suction chamber 7 is beyond Ps1, and control valve 25 closes first passage 24. Moment M1 and moment M3 are substantially the same because pressure Ps in suction chamber 7, pressure Pc in crank chamber 4, and pressure in discharge chamber 8 are substantially the same. As a result, tilt angle θ between slant plate 13 and drive shaft 10 reaches minimum angle due to moment M2, and the discharge capacity of compressor 100 reaches minimum discharge capacity. Thereafter, pressure Ps in suction chamber 7 decreases because refrigerant gas in suction chamber 7 is drawn into cylinder bores 1. Nevertheless, the amount of refrigerant gas drawn into cylinder bores 1 is a smaller amount because the discharge capacity of compressor 100 reaches a minimum discharge capacity. Therefore, the amount of a decrease of pressure Ps is a smaller amount.

Accordingly, just after compressor operation begins, pressure difference ΔP between pressure Pc in crank chamber 4 and pressure Ps in suction chamber 7 is less than ΔP1, and cross-sectional area S of orifice 31 reaches maximum value S1. As a result, pressure difference ΔP is reduced although refrigerant gas may rapidly flow to suction chamber 7 through third passage 33 because cross-sectional area S is enlarged, and pressure Pc in crank chamber 4 may rapidly decrease. Thereafter, tilt angle θ between slant plate 13 and drive shaft 10 may rapidly increase due to a rapid decrease of moment M3, and the discharge capacity of compressor 100 may rapidly increase. In connection with an increase of the discharge capacity of compressor 100, the amount of refrigerant gas drawn from suction chamber 7 into cylinder bores 1 may increase, and the amount of a decrease of pressure Ps in suction chamber may grow larger. As a result, pressure difference ΔP between pressure Pc in crank chamber 4 and pressure Ps in suction chamber 7 may increase and exceed ΔP1, cross-sectional area S of orifice 31 may decrease toward minimum value S2 from maximum value S1. When pressure difference ΔP exceeds ΔP2 and cross-sectional area S reaches minimum value S2, the discharge capacity of compressor 100 may increase by a requisite amount, and a requisite amount of refrigerant gas may be provided to the fluid circuit.

With the passage of the transitional period for just after the starting of compressor 100, when pressure Ps in suction chamber 7 decreases to about predetermined value Ps1, pressure difference ΔP exceeds ΔP2, and cross-sectional area S of orifice 31 reaches minimum value S2. In such a condition, compressor 100 is operated in a capacity control operation. In brief, opening or closing control valve 25 is controlled in response to pressure Ps in suction chamber 7, and the discharge capacity of compressor 100 is controlled in accordance with changing of the load on the fluid circuit.

During the capacity control operation, cross-sectional area S of orifice 31 reaches minimum value S2, and the amount of the flow of refrigerant gas discharged into suction chamber 7 through third passage 33 may be small. As a result, when the discharge capacity of compressor 100 is increased and controlled, a rapid decrease of pressure Pc in crank chamber 4 may be prevented, and a rapid decrease of moment M3 also may be prevented. Accordingly, a rapid increase of tilt angle θ between slant plate 13 and drive shaft 10 may be prevented, and a rapid increase of the discharge capacity of compressor 100 also may be prevented. Therefore, a rapid decrease of blowoff temperature of the automotive air conditioning system may be suppressed. Moreover, because cross-sectional area S of orifice 31 reaches minimum value S1 during the capacity control operation, the amount of refrigerant gas in discharge chamber 8 drawn into suction chamber 7 through crank chamber 4 for controlling the discharge capacity of compressor 100 is reduced. Therefore, during the capacity control operation, a loss of motive energy of compressor 100 also may be reduced.

As described above, with respect to an embodiment of the present invention of a slant plate-type compressor having a capacity control mechanism, because cross-sectional area S of orifice 31 is variably controlled in order that a cross-sectional area S in starting of the compressor operation is greater than that in a capacity control operation, when operation of compressor 100 is started, pressure Pc in crank chamber 4 rapidly decreases, and moment M3, which decreases tilt angle θ between slant plate 13 an drive shaft 10 resulting from pressure Pc in crank chamber 4, rapidly decreases. As a result, the difference between a first moment increasing tilt angle θ between slant plate 13 and drive shaft 10, and a second moment decreasing tilt angle θ between slant plate 13 and drive shaft 10 may rapidly increase. The first moment results from a reaction force of a compression, which affects pistons 18. The second moment results from pressure Ps in crank chamber 4. Accordingly, tilt angle θ between slant plate 13 and drive shaft 10 may rapidly increase, and the discharge capacity of compressor 100 may rapidly increase.

On the other hand, because cross-sectional area S of orifice 31 during the capacity control operation is smaller than that when compressor operation begins, when the discharge capacity is increased and controlled in accordance with an increase of a load on the fluid circuit, a rapid decrease of pressure Pc in crank chamber 4 is prevented, and a rapid decrease of moment M3, which decreases tilt angle θ between slant plate 13 and drive shaft 10 resulting from pressure Pc in crank chamber 4, is also prevented. As a result, a rapid increase of the difference between the first moment and the second moment may be suppressed, and a rapid increase of the discharge capacity of compressor 100 may be suppressed. Moreover, because cross-sectional area S of orifice 31 is reduced during the capacity control operation, the amount of refrigerant gas in discharge chamber 8 drawn into suction chamber 7 through crank chamber 4 is reduced. As a result, during the capacity control operation, a loss of motive energy of compressor 100 may be reduced.

Although the present invention has been described in connection with preferred embodiments, the invention is not limited thereto. It will be understood by those skilled in the art that variations and modifications may be made within the scope and spirit of this invention, as defined by the following claims.

What is claimed is:

1. A slant plate-type variable displacement compressor comprising:

a housing comprising a crank chamber which is adapted to contain a fluid, a suction chamber, and a discharge chamber, said housing including a cylinder block, wherein a plurality of cylinder bores are formed in said cylinder block;

a drive shaft rotatably supported in said cylinder block;

a plurality of pistons slidably disposed within said cylinder bores;

a slant plate having an angle if tilt and tiltably connected to said drive shaft;

a plurality of bearings coupling said slant plate to each of said pistons, so that said pistons reciprocate within said cylinder bores upon rotation of said slant plate;

first valve member disposed in a first passage, said first passage communicating between a discharge side of said cylinder bore and said crank chamber, and said first valve member controlled by a suction pressure produced within said cylinder bore; and a second passage communicating between said crank chamber and a suction side of said cylinder bore through an orifice, said second passage allowing pressure to release, wherein a cross-sectional area of said orifice is variable controlled by a linear flow of said fluid through said orifice, such that said cross sectional area of said orifice when a compressor operation begins is greater than that during a capacity control operation.

2. The slant plate-type variable displacement compressor of claim 1, wherein a cross-sectional area of said orifice is variably controlled, such that when a pressure difference between a pressure in said crank chamber and a suction pressure of said cylinder bore is less than a predetermined value, said cross-sectional area is greater than that when said pressure difference exceeds said predetermined value.

3. The slant plate-type variable displacement compressor of claim 1, wherein a cross-sectional area of said orifice is variably controlled by a mechanism, said mechanism comprising:

an orifice opening having a larger diameter portion on an upstream side of said orifice and a smaller diameter portion on a downstream side of said orifice with respect to flow of refrigerant gas in said second passage;

a second valve member having a ball shape, said valve member disposed in said orifice opening; and a spring disposed in said orifice opening, wherein said spring urges said second valve member in an upstream direction with respect to flow of refrigerant gas in said second passage.

* * * * *